US005375360A

United States Patent [19]

Vatterott

[11] Patent Number: 5,375,360

[45] Date of Patent: Dec. 27, 1994

[54] CUSHIONED SHOULDER PAD FOR RIFLE OR SHOTGUN

[75] Inventor: Oskar F. Vatterott, Pacific, Mo.

[73] Assignee: C.G.I. Corporation, Vincennes, Ind.

[21] Appl. No.: 53,995

[22] Filed: Apr. 22, 1993

[51] Int. Cl.[5] ..... F41C 23/08

[52] U.S. Cl. ..... 42/74

[58] Field of Search ..... 42/74, 71.01

[56] References Cited

U.S. PATENT DOCUMENTS

| | | | |
|---|---|---|---|
| 1,785,977 | 12/1930 | Pruyn | 42/74 |
| 2,455,438 | 12/1948 | Oppold | 42/74 |
| 3,019,543 | 2/1962 | Ducharme | 42/74 |
| 3,207,496 | 9/1965 | Hrebicek | 42/74 |
| 3,371,442 | 3/1968 | Carlson | 42/74 |
| 3,696,544 | 10/1972 | Webb | 42/74 |
| 4,683,671 | 8/1987 | Farrar | 42/74 |
| 4,922,641 | 5/1990 | Johnson | 42/74 |

FOREIGN PATENT DOCUMENTS

| | | | |
|---|---|---|---|
| 792113 | 12/1935 | France | 42/74 |

*Primary Examiner*—Stephen M. Johnson

*Attorney, Agent, or Firm*—Polster, Lieder, Woodruff & Lucchesi

[57] ABSTRACT

A recoil pad assembly (10) fitted to the stock of a weapon (W) such as a rifle or shotgun for cushioning a shooter (M) against recoil forces produced when the weapon is discharged. A first pad member (12) is installed on a butt end (E) of the stock (T) of the weapon. A second pad member (14) is pressed against a shoulder (S) of the shooter when the shooter prepares to discharge the weapon. The second pad member interfits with the first pad member for movement of the pad members relative to each other when the weapon is discharged. Compression springs (56) then restore the pad members to their original position relative to each other. A seal is effected between the pad members when the weapon is discharged trapping air between the members. Relative movement of the pad members then compresses the air producing a cushioning effect which lessens the recoil force to which the shooter is subjected.

17 Claims, 5 Drawing Sheets

Stop Groove

Stop Groove

CUSHIONED SHOULDER PAD FOR RIFLE OR SHOTGUN

BACKGROUND OF THE INVENTION

This invention relates to rifles and shotguns and, more particularly, to a recoil pad installed on these weapons to help reduce the recoil experienced by a shooter when the weapon is fired.

Most people who have handled firearms, particularly shotguns and the larger bore rifles, are aware of the recoil or "kick" which occurs when the weapon is fired. As most people know, when firing these weapons, the butt end of the stock of the weapon is firmly set against the shooter's shoulder. The shooter then takes a stance in which he or she braces themself against the kick they know they will feel when they pull the trigger. Originally, the carved but end of the stock was directly fitted against the shoulder. Over time, various types of pads were developed to help cushion the shooter against the recoil forces. The pads were made of different types of material and attached to the butt by screws, or by gluing the inner face of the pad to the butt. Later, composite pads were developed. In these pad constructions, one portion of the pad remained fixed while the other moved relative to it when the weapon was discharged. Although each of the various pads afford some degree of recoil cushioning, there is still a great deal which can be done to further cushion the shooter from the recoil.

SUMMARY OF THE INVENTION

Among the several objects of the present invention may be noted the provision of a recoil pad assembly for use on rifles and shotguns; the provision of such a recoil pad assembly which can be retrofitted on the existing stock of a rifle or shotgun or which can be installed on the stock during fabrication of the weapon; the provision of such a recoil pad assembly in which a portion of the assembly can be fabricated as part of the stock; the provision of such a recoil pad assembly which substantially reduces the "Kick" felt by a shooter when he fires a weapon on which the assembly is installed; the provision of such a recoil pad assembly which in which one portion of the assembly moves relative to a second portion thereof to help effect the cushioning against the recoil forces; the provision of such a recoil pad assembly which is quickly restored to its initial position after cushioning against a shot whereby if the weapon is capable of rapid fire, the assembly cushions against each rapidly discharged round; the provision of such a recoil pad assembly which withstands rugged use and has a long functional life; and, the provision of such a recoil pad assembly which is self-adjusting for each shooter and which is available in different configurations so to permit installation on different size stocks and stocks having different butt-end contours.

In accordance with the invention, generally stated, a recoil pad assembly is fitted to the stock of a weapon such as a rifle or shotgun for cushioning a shooter against the recoil forces produced when the weapon is discharged. The pad assembly comprises a first pad member installed on a butt end of the stock of the weapon. A second pad member is pressed against a shoulder of the shooter when the shooter prepares to discharge the weapon. This second pad member interfits with the first pad member for movement of the pad members relative to each other when the weapon is discharged. A spring arrangement installed within the assembly acts to restore the pad members back to their original positions relative to each other. The pad members seal against each other when the weapon discharges trapping air between the pad members. The simultaneous relative movement of the pad members compresses the trapped air and produces a cushioning effect which lessens the recoil force to which the shooter is subjected. Other objects and features will be in part apparent and in part pointed out hereinafter.

DESCRIPTION OF PREFERRED EMBODIMENTS

Figure 1:
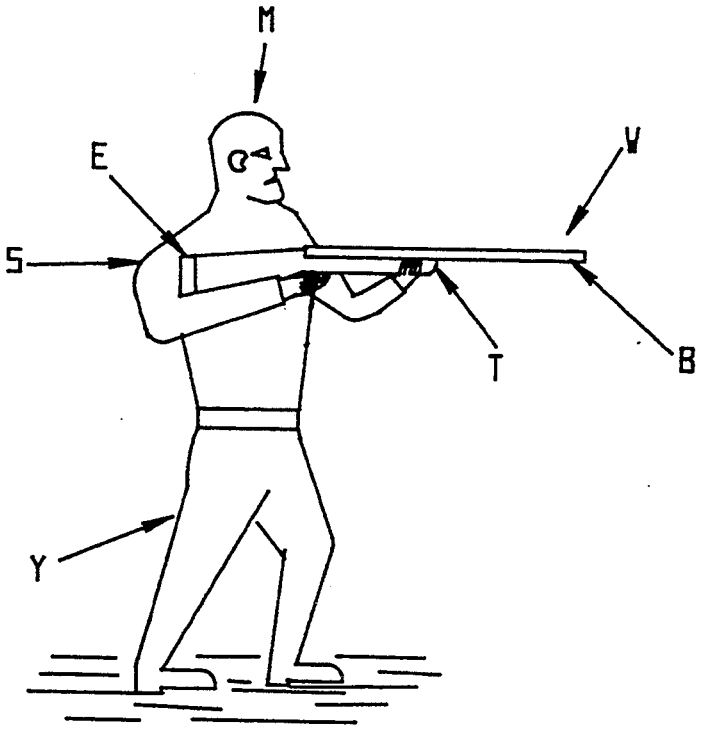
FIG. 1 is a representation of a shooter preparing to fire a rifle or shotgun on which a recoil pad assembly of the present invention is installed.
Figure 1A:
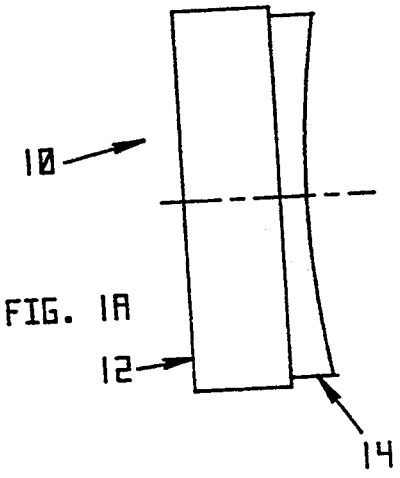
FIG. 1A is a side elevational view of the recoil pad assembly.

Referring to the drawings, FIG. 1A is a representation of a shooter M preparing to fire a weapon W such as a rifle or shotgun. The weapon includes a barrel B mounted on a stock T. As is well-known, the stock is a contoured piece of wood or formed plastic which not only forms a mounting frame for the barrel, but also a trigger/firing pin mechanism (not shown). The stock also has a butt-end E which the shooter fits against his shoulder S when he prepares to fire the weapon. He also assumes a stance in which he braces his body Y against the recoil forces produced when he discharges the weapon. A recoil pad assembly 10 of the present invention is installed on the butt-end of the stock. As is described hereinafter, when the shooter discharges the weapon, the pad assembly substantially lessens the "kick" felt by the shooter.

As noted, recoil pad assembly 10 is fitted to stock T of the rifle or shotgun to provide cushioning a shooter against the recoil forces produced when he fires the weapon. Referring to FIG. 1B assembly 10 includes a first pad member 12 which is installed on butt end E of rifle or shotgun stock T. The assembly further includes a second pad member 14 which, as described herein, interfits with pad member 12. Pad members 12 and 14 are movable relative to one another when the weapon is fired. A restoring means 16 (see FIGS. 2A and 2B) then acts to restore the pad members to their initial positions relative to one another. Means 16 does this quickly so if the weapon is a rapid fire weapon, the cushioning effect created by the assembly will occur with each round fired. Because of the different sizes and shapes of stocks, the respective pad members are of different sizes so they can be used with a wide variety of stocks.

Figure 2B:
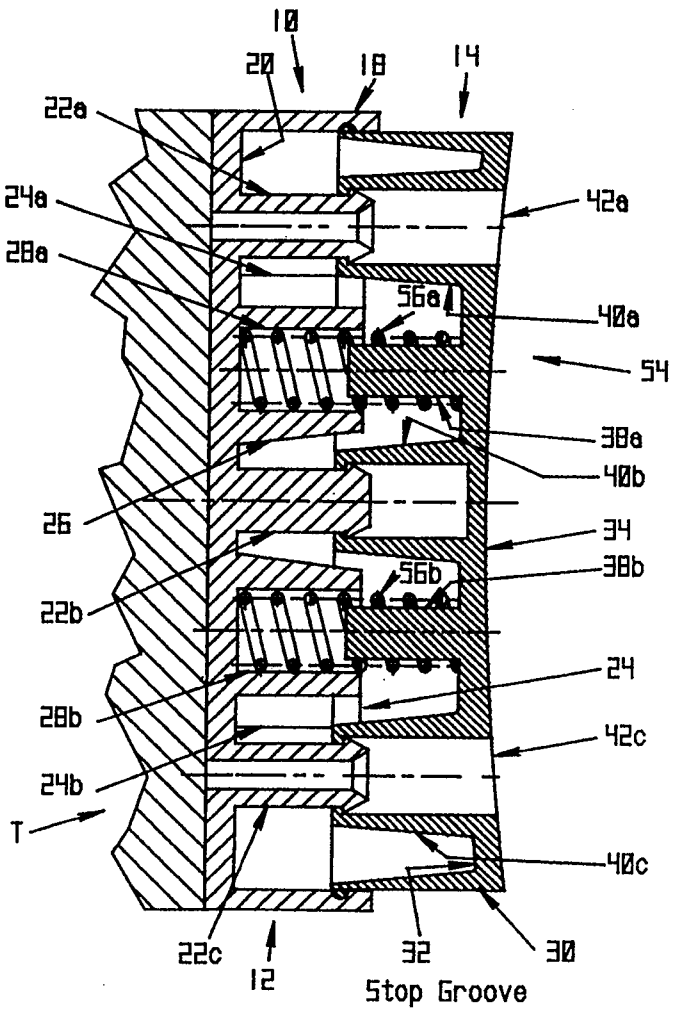
FIG. 2B is a similar view to that of FIG. 2A but in which a portion of the assembly is integrally formed with the butt-end of a rifle or shotgun stock.
Figure 2A:
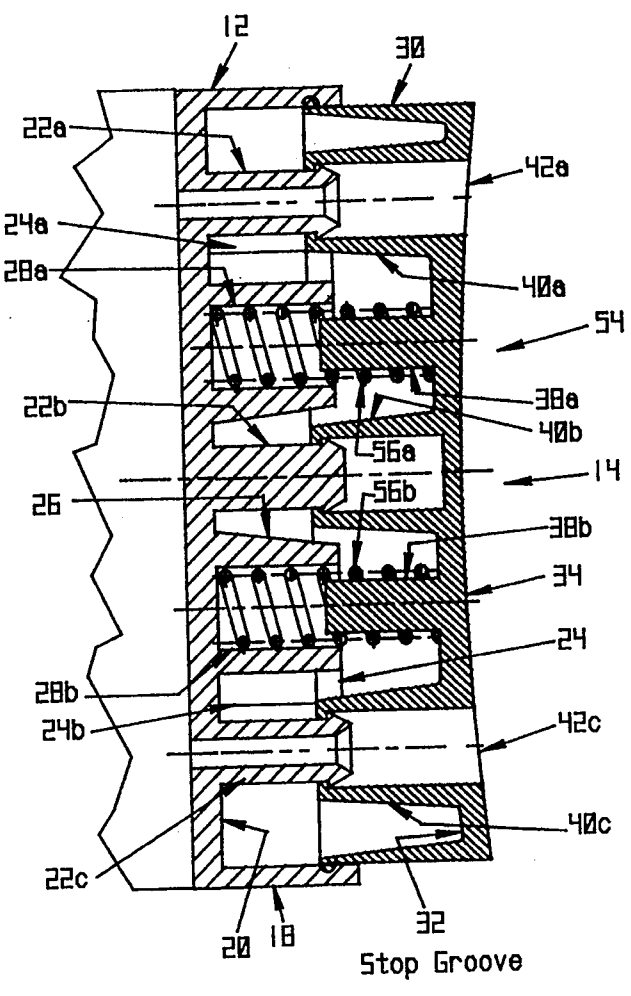
FIG. 2A is a sectional view of a first embodiment of the recoil pad assembly.
Figure 4:
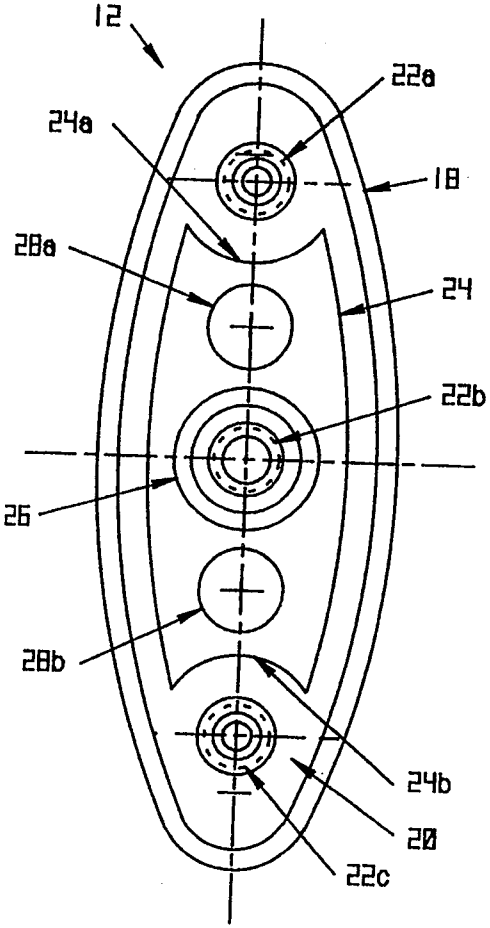
FIG. 4 is an elevational view of the outer face of the first pad member.
Figure 3:
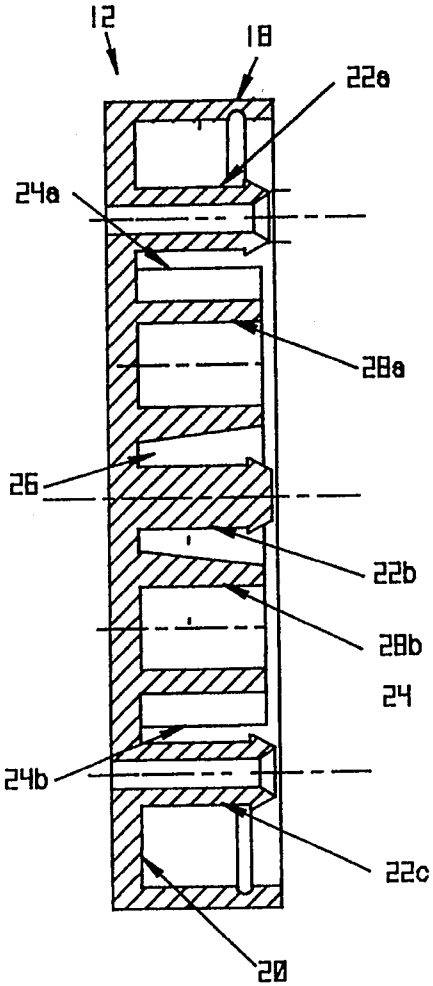
FIG. 3 is a sectional view of a first pad member of the assembly.

Referring to FIGS. 2A, 3 and 4, pad member 12 is formed of a hard plastic material; or, as shown in FIG. 2B, the pad member may be integrally formed with the butt end of stock T. Regardless of the embodiment of the first pad member, it is shown in FIG. 4 to have an elongate, oval end shape, with a circumferentially extending sidewall 18. The pad member has an outer or rear face 20 from which projects or extends a plurality of posts 22. As seen in FIG. 4, for example, the pad member has three such posts; an upper post 22*a*, a middle post 22*b*, and a lower post 22*c*. A raised central section 24 also extends rearwardly from outer face 20 of the pad member. Section 24 also has an elongate, oval shape. The upper and lower ends 24*a*, 24*b* of section 24 are concave or scalloped to provide a clearance about the respective upper and lower posts. Section 24 also has a circular central recess formed by an inwardly extending bore 26. Middle post 22*b* is formed within this recess. Section 24 also has upper and lower inwardly extending bores forming sleeves 28*a*, 28*b*.

As best shown in FIG. 4, the respective posts and sleeves are centrally aligned with each other. Further, the arrangement of posts and sleeves is such that they are interposed with each other so to form the arrangement (from top to bottom as viewed in FIG. 4) of post 22*a*-sleeve 28*a*-post 22*b*-sleeve 28*b*-post 22*c*.

Figure 6:
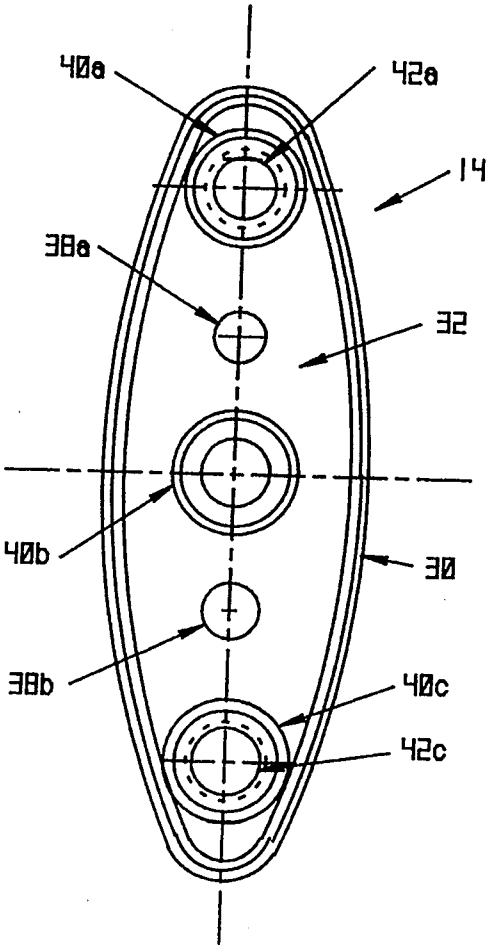
FIG. 6 is an elevational view of the inner face of the second pad member.
Figure 8:
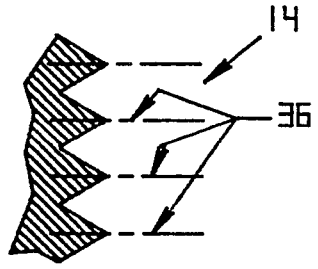
FIG. 8 is an enlarged partial elevational view of outer face illustrating serrations formed on the face; and, Corresponding reference characters indicate corresponding parts throughout the drawings.

Second pad member 14 is pressed against a shoulder of the shooter when he brings the weapon into firing position. As previously mentioned, pad member 14 interfits with pad member 12 and the pad members move relative to each other when the weapon is fired. In FIG. 6, pad member 14 is seen to also have an elongate oval shape. The overall dimensions of pad member 14 are, however, smaller than those of pad member 12 for pad member 14 to fit within sidewall 18 of pad member 12. Pad member 14 is also formed of a plastic material which is somewhat less hard than the material from which pad member 12 is formed and is therefore more pliable. The pad member has a circumferentially extending sidewall 30 which is thinner than sidewall 18 of pad member 12. The pad member has an inner face 32 and an outer face 34. Outer face 34 is formed with serrations 36 (see FIG. 8) and is the surface of the recoil pad assembly which the shooter presses against his or her shoulder prepatory to firing the weapon.

Figure 5:
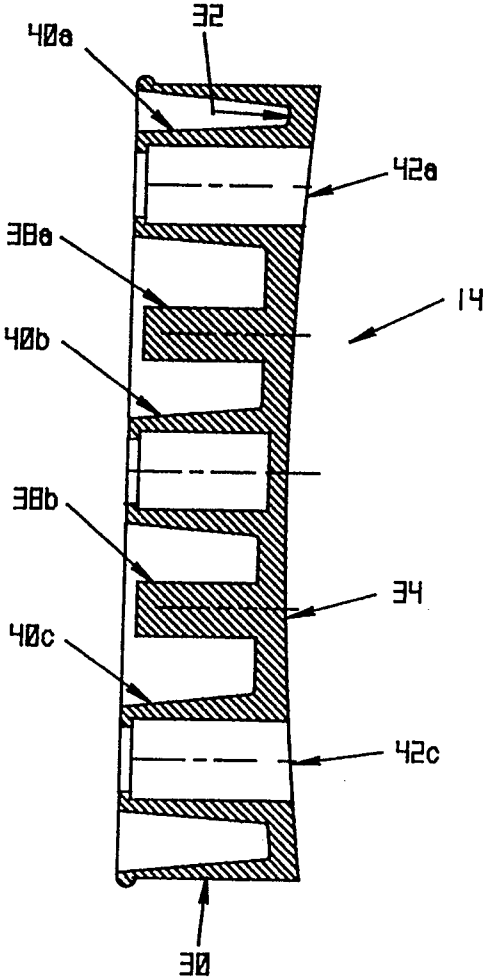
FIG. 5 is a sectional view of a second pad member of the assembly.
Figure 7:
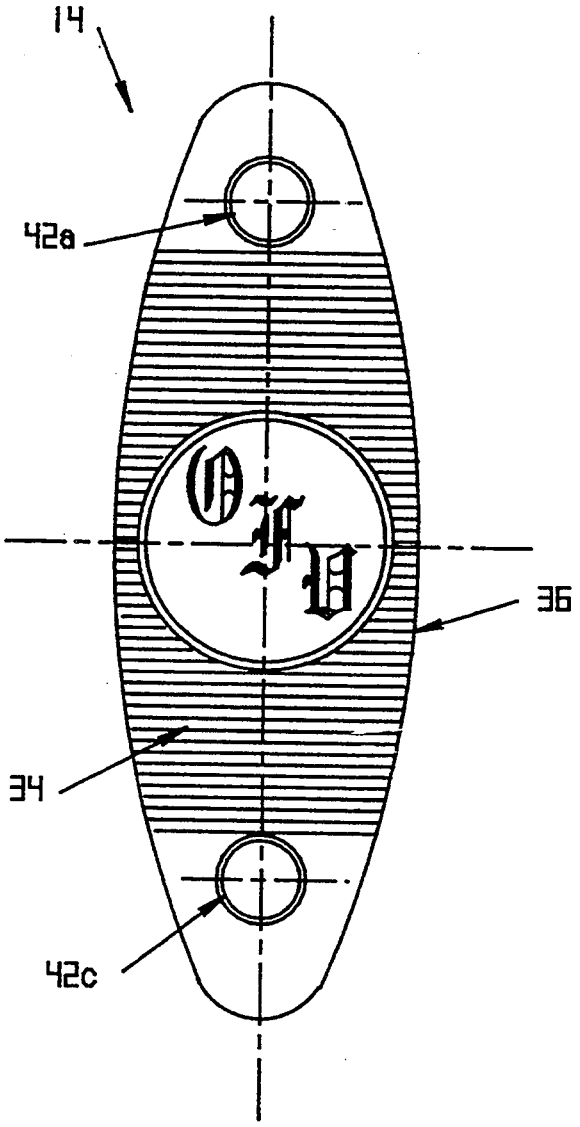
FIG. 7 is an elevational view of the outer face thereof.

A plurality of posts 38 extend forwardly from inner face 32. As seen in FIGS. 5 and 6, there are two such posts; an upper post 38*a*, and a lower post 38*b*. In addition three hollow cylindrical sleeves 40 also extend forwardly from face 32. There are three such sleeves, an upper sleeve 40*a*, a middle sleeve 40*b*, a lower sleeve 40*c*. As shown in FIGS. 2A and 5, the outer end of the upper and lower sleeves is not closed, as is middle sleeve 40*b*. Rather, openings 42*a*, 42*c* are formed the pad member at the outer end of the sleeves. It will be noted that the posts 22*a* and 22*c* which fit in these open ended sleeves are hollow posts. The inner diameter of each of sleeves 40*a*–40*c* is such that respective posts 22*a*–22*c* sliding fit in them. Similarly, sleeves 28*a* and 28*b* of pad member 12 have an inner diameter corresponding to that of posts 38*a*, 38*b*, so these posts slidingly fit in the sleeves. As with pad member 12, the respective posts and sleeves of pad member 14 are centrally aligned with each other. Again, the arrangement of posts and sleeves is such that they are interposed with each other so to form the arrangement (from top to bottom as viewed in FIG. 6) of sleeve 40*a*-post 38*a*-sleeve 40*b*-post 38*b*-sleeve 40*c*.

Because the posts 22*a*–22*c* of pad member 12 slidingly fit in sleeves 40*a*–40*c* of pad member 14, and posts 38*a*, 38*b* of pad member 14 slidingly fit in sleeves 28*a*, 28*b* of pad member 12, the respective pad member can move relative to one another. Referring to FIG. 9, each post 22 of pad member 12 has a frusto-conical or tapered head 44. Each head has a rear shoulder 46 which is of an increased diameter than that of a shank portion 48 of the post. From shoulder 44, each head tapers forwardly to a truncated forward end 50. The end of each sleeve 40 in which the head of the associated post fits has an inwardly turned flange 52. The flange provides a reduced diameter opening of the sleeve in which head 44 of the post is received. This serves to capture the head in the sleeve so that while the post can freely move back and forth in the sleeve, it cannot be withdrawn from the sleeve.

The posts 38 on pad member 14 do not have these heads, and their associated sleeves 28 do not include the flange. This is because pad assembly 10 further includes the means 16 for restoring pad members 12 and 14 to their original position relative to each other after the assembly has absorbed the recoil force created when the weapon is fired. Restoring means 16 comprises a coil compression spring 56 installed over each post 38 of pad member 14. Thus, a coil spring 56*a* is installed on post 38*a*, and a coil spring 56*b* on post 38*b*. One end of each spring 56 seat against inner face 32 of pad member 14 and the other end of the spring seats against the inner end of the associated sleeve 28. Both springs 56*a* and 56*b* are stiff springs which require a substantial amount of force to compress. Also, compression springs of different stiffness can be used depending upon the amount of recoil reduction desired. However, the springs do allow sufficient movement of the pad members that they self-adjust to each shooter who uses the weapon.

In use, when the shooter prepares to fire, he presses face 34 of pad member 14 against his shoulder. Because of the stiffness of the springs 56, this does not cause the pad member to move too far relative to pad 12. At discharge, the recoil force forces the stock, including pad member 12 to move rearwardly against the force of the springs. As noted, sidewall 30 of pad member 14 is somewhat thinner than sidewall 18 of pad member 12. At the moment of discharge, the sidewall of pad member 14 is forced outwardly against sidewall 18. This action forms a seal trapping air between the pad members. Further, because sleeve 40*b* is a closed end sleeve, air is trapped in the sleeve. The trapped air is compressed by the movement of pad member 12 into pad member 14, including the movement of post 22*b* in the sleeve. This, together with the resistive force exerted by the springs 56 produces a cushioning effect which reduces the "kick" felt by the shooter. The energy stored in the springs and the compressed air in sleeve 40*b* then produces movement of pad member 12 back to its initial position. Pad member 12 includes a circumferential stop groove 58 formed on the inside of sidewall 18 toward the outer end of the sidewall. Groove 58 limits the movement of pad member 14 so that it stops in its original position relative to pad member 12. It will be appreciated that these recoil and restorative movements occur very quickly. This is important where the weapon is a rapid fire weapon, since it means the recoil pad assembly will help reduce the recoil forces for each shot fired.

What has been described is a recoil pad assembly for use on rifles and shotguns. The assembly can be retrofitted on the existing stock of a rifle or shotgun or it can be installed on the stock during fabrication of the weapon. If preferred, a portion of the assembly can be fabricated as part of the stock. In either event, the recoil pad assembly substantially reduces the "kick" felt by a shooter when he fires his rifle or shotgun. When the weapon is fired, one portion of the pad assembly moves relative to a second portion of the assembly to cushion the shooter against the recoil forces. The assembly is quickly restored to its initial position after cushioning against a shot, so if the weapon is a rapid fire weapon, the assembly will cushion against each rapidly fired round. The recoil pad assembly is capable of withstanding rugged use, has a long functional life, and is available in different configurations so to permit installation on different size stocks and stocks having different butt-end contours.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A recoil pad assembly fitted to a stock of a weapon for cushioning a shooter against recoil forces produced when the weapon is discharged comprising:

a first pad member installed on a butt end of the stock of the weapon;

a second pad member which is pressed against a shoulder of the shooter when the shooter prepares to discharge the weapon, the second pad member interfitting with said first pad member for movement of said first and second pad members relative to each other when the weapon is discharged said first pad member including a plurality of posts extending rearwardly of an outer face of said first pad member, and said second pad member including a plurality of sleeves extending forwardly of an inner face of said second pad member, said sleeves being sized to receive said posts for slidable movement therewithin, said second pad member also including a plurality of posts extending forwardly of said inner face thereof, and said first pad member also including a plurality of sleeves extending rearwardly of said outer face thereof, said posts of said second pad member being sized to be received in said sleeves of said first pad member; and, means for restoring said first and second pad members to their original position relative to each other, relative movement of said pad members when the weapon discharges producing a cushioning effect which lessens the recoil force to which the shooter is subjected.

2. The recoil pad assembly of claim 1 wherein said first pad member has a contoured inner surface a profile of which matingly corresponds with a profile of the butt end of the stock for said first pad member to be installed on the butt end.

3. The recoil pad assembly of claim 2 wherein said first pad member is integrally formed as part of the butt end of the stock.

4. The recoil pad assembly of claim 2 wherein said second pad member has a contoured outer surface which allows said outer surface to fit snugly against a shoulder of the shooter.

5. The recoil pad assembly of claim 3 wherein said first pad member is formed of a first plastic material, and the second pad member is formed of a soft second and softer plastic material.

6. The recoil pad assembly of claim 5 wherein the respective posts and sleeves of said first pad member are interposed with each other as are the respective posts and sleeves of said second pad member thereby for the first and second pad members to interfit with each other.

7. The recoil pad assembly of claim 6 wherein each post of said first pad member has an enlarged diameter head formed at an outer end thereof with a circumferential, inwardly extending shoulder formed at a rearward end of each said head, and said associated sleeve of said second pad member has a reduced diameter shoulder at an outer end of said sleeve in which the head of the post of said first pad member fits thereby to capture said post in said sleeve for sliding movement therewithin, thereby to axially align said first and second pad members.

8. The recoil pad assembly of claim 7 wherein each said pad member has a sidewall with the sidewall of said second pad member fitting within the sidewall of said first pad member, the sidewall of said second pad member sealing against the sidewall of said first pad member when said weapon is fired to trap air between the pad members, the relative movement of said pad members compressing the trapped air to provide the cushioning.

9. The recoil pad assembly of claim 8 wherein said restoring means comprises a plurality of coil springs including a coil spring installed over each post of said second pad member for one end of each said spring to seat against said inner face of said second pad member and for the other end thereof to seat against an inner end of the associated sleeve of said first pad member in which said posts are received, movement of said respective posts in their associated sleeves, when the weapon is discharged, compressing air captured within a sleeve to produce a cushioning effect which absorbs the recoil force produced by the discharge.

10. A recoil pad assembly fitted to a stock of a weapon for cushioning a shooter against recoil forces produced when the weapon is discharged comprising:

a first pad member installed on a butt end of the stock of the weapon, said first pad member including a plurality of posts extending rearwardly of an outer face thereof;

a second pad member which is pressed against a shoulder of the shooter when the shooter prepares to discharge the weapon, the second pad member interfitting with said first pad member for movement of said first and second pad members relative to each other when the weapon is discharged, said second pad member including a plurality of sleeves extending forwardly of an inner face thereof, said sleeves being sized to receive said posts for slidable movement therewithin, said second pad member sealing against said first pad member when said weapon is discharged to trap air between the pad members, said second pad member further including a plurality of posts extending forwardly of said inner face thereof, and said first pad member includes a plurality of sleeves extending rearwardly of said outer face thereof, said posts of said second pad member being sized to be received in said sleeves of said first pad member; and, means for restoring said first and second pad members to an original position relative to each other, relative movement of said pad members when the weapon discharges compressing the air trapped therebetween to produce a cushioning effect which lessens the recoil force to which the shooter is subjected.

11. The recoil pad assembly of claim 10 wherein said restoring means comprises a coil spring installed over each said post of said second pad member for one end of each said spring to seat against said inner face of said second pad member and for the other end thereof to seat against the inner end of the associated sleeve of said first pad member in which said posts are received, movement of said respective posts in their associated sleeves, when the weapon is discharged, compressing air captured within a sleeve to produce a cushioning effect which absorbs the recoil force produced by the discharge.

12. The recoil pad assembly of claim 10 wherein said first pad member is formed of a first plastic material, and said second pad member is formed of a second and softer plastic material.

13. The recoil pad assembly of claim 10 wherein each said pad member has a sidewall with the sidewall of said second pad member fitting within the sidewall of said first pad member, the sidewall of said second pad member sealing against the sidewall of said first pad member when said weapon is fired to trap air between the pad members, the relative movement of said pad members compressing the trapped air to provide the cushioning.

14. A recoil pad assembly fitted to a stock of a weapon for cushioning a shooter against recoil forces produced when the weapon is discharged comprising:

a first pad member installed on a butt end of the stock of the weapon, said first pad member including a plurality of posts extending rearwardly of an outer face thereof;

a second pad member which is pressed against a shoulder of the shooter when the shooter prepares to discharge the weapon, the second pad member interfitting with said first pad member for movement of said first and second pad members relative to each other when the weapon is discharged, said second pad member including a plurality of sleeves extending forwardly of an inner face thereof, said sleeves being sized to receive said posts for slidable movement therewithin, and said second pad member also including a plurality of posts extending forwardly of said inner face thereof with said first pad member further including a plurality of sleeves extending rearwardly of said outer face thereof, said posts of said second pad member being sized to be received in said sleeves of said first pad member;

sidewalls formed on each of said first and second pad members with the sidewall of said second pad member fitting within the sidewall of said first pad member, the sidewall of said second pad member sealing against the sidewall of said first pad member when said weapon is fired to trap air between the pad members, and, means for restoring said first and second pad members to an original position relative to each other, relative movement of said pad members when the weapon discharges compressing the air trapped between said pad members to produce a cushioning effect which lessens the recoil force to which the shooter is subjected.

15. The recoil pad assembly of claim 14 wherein said restoring means comprises a coil spring installed over each said post of said second pad member for one end of each said spring to seat against said inner face of said second pad member and for the other end thereof to seat against an inner end of the associated sleeve of said first pad member in which said posts are received, movement of said respective posts in their associated sleeves, when the weapon is discharged, compressing air captured within a sleeve to produce a cushioning effect which absorbs the recoil force produced by the discharge.

16. The recoil pad assembly of claim 15 wherein said first pad member is formed of a first plastic material, and said second pad member is formed of a second and softer plastic material.

17. The recoil pad assembly of claim 16 wherein said first pad member is integrally formed as part of the butt end of the stock.

* * * * *